US009728139B2

(12) United States Patent
Lim

(10) Patent No.: US 9,728,139 B2
(45) Date of Patent: Aug. 8, 2017

(54) ORGANIC LIGHT EMITTING DISPLAY DEVICE HAVING A PLURALITY OF DATA DRIVING CIRCUITS

(71) Applicant: SAMSUNG DISPLAY CO., LTD., Yongin, Gyeonggi-Do (KR)

(72) Inventor: Hyun-Ho Lim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 115 days.

(21) Appl. No.: 14/608,156

(22) Filed: Jan. 28, 2015

(65) Prior Publication Data

US 2015/0243221 A1 Aug. 27, 2015

(30) Foreign Application Priority Data

Feb. 25, 2014 (KR) ..... 10-2014-0021897

(51) Int. Cl.
*G09G 3/30* (2006.01)
*G09G 3/3291* (2016.01)
(Continued)

(52) U.S. Cl.
CPC ..... *G09G 3/3291* (2013.01); *G09G 3/2022* (2013.01); *G09G 3/3258* (2013.01);
(Continued)

(58) Field of Classification Search
CPC .. G09G 3/3275; G09G 3/3291; G09G 3/3258; G09G 3/2022
(Continued)

(56) References Cited

U.S. PATENT DOCUMENTS

2003/0132903 A1* 7/2003 Ueda ..... G09G 3/3614 345/87
2006/0071884 A1* 4/2006 Kim ..... G09G 3/3233 345/76
(Continued)

FOREIGN PATENT DOCUMENTS

KR 10-2008-0019776 A 3/2008
KR 10-2008-0111848 A 12/2008
(Continued)

OTHER PUBLICATIONS

Korean Patent Abstract for KR 10-2011-0101416 A, which corresponds to KR Publ. No. 10-1219439 B1, published Sep. 16, 2011, 1 page.

*Primary Examiner* — Adam J Snyder
(74) *Attorney, Agent, or Firm* — Lewis Roca Rothgerber Christie LLP

(57) ABSTRACT

An organic light emitting display device includes: a plurality of pixels coupled to scan lines and data lines; a plurality of scan driving circuits configured to receive a circuit selection signal and a line control signal, and to output a scan signal to the scan lines, corresponding to the circuit selection signal and the line control signal; a plurality of data driving circuits respectively coupled to the data lines, the plurality of data driving circuits being configured to select at least one of a first pre-emphasis voltage, a second pre-emphasis voltage, a first data voltage or a second data voltage, and to output the selected voltage to a corresponding one of the data lines; and a first decoder configured to supply the first pre-emphasis voltage, corresponding to the circuit selection signal and the line control signal.

18 Claims, 5 Drawing Sheets

(51) Int. Cl.
*G09G 3/3258* (2016.01)
*G09G 3/20* (2006.01)
*G09G 3/10* (2006.01)

(52) U.S. Cl.
CPC ..... *G09G 2300/0842* (2013.01); *G09G 2310/0248* (2013.01); *G09G 2310/0251* (2013.01); *G09G 2320/0252* (2013.01)

(58) Field of Classification Search
USPC ..... 345/76, 169.3
See application file for complete search history.

(56) References Cited

U.S. PATENT DOCUMENTS

2007/0139313 A1* 6/2007 Choi ..... G09G 3/2011 345/76
2007/0279336 A1* 12/2007 Park ..... G09G 3/3291 345/76
2007/0279341 A1* 12/2007 Park ..... G09G 3/3291 345/77
2008/0303804 A1 12/2008 Schmidt et al.
2009/0146985 A1* 6/2009 Okada ..... G09G 3/2011 345/211
2010/0020114 A1* 1/2010 Lee ..... G09G 3/3688 345/690
2012/0169678 A1* 7/2012 Shin ..... G09G 3/20 345/204
2012/0187304 A1 7/2012 Ha et al.
2012/0194224 A1 8/2012 Moon et al.
2013/0300773 A1* 11/2013 Kim ..... G09G 3/3677 345/690

FOREIGN PATENT DOCUMENTS

KR 10-1219439 B1 1/2013
KR 10-1290080 B1 7/2013

* cited by examiner

ORGANIC LIGHT EMITTING DISPLAY DEVICE HAVING A PLURALITY OF DATA DRIVING CIRCUITS

CROSS-REFERENCE TO RELATED APPLICATION

This application claims priority to and the benefit of Korean Patent Application No. 10-2014-0021897, filed on Feb. 25, 2014, in the Korean Intellectual Property Office, the entire content of which is incorporated herein by reference in its entirety.

BACKGROUND

1. Field

An aspect of embodiments of the present invention relates to an organic light emitting display device.

2. Description of Related Art

Recently, there have been developed various types of flat panel displays capable of reducing the weight and volume of cathode ray tubes, which are disadvantages. Examples of flat panel displays include a liquid crystal display, a field emission display, a plasma display panel, an organic light emitting display, and the like.

Among these flat panel displays, the organic light emitting displays display images using organic light emitting diodes that emit light through recombination of electrons and holes. The organic light emitting display has a fast response speed and is simultaneously driven with low power consumption.

SUMMARY

According to an aspect of the present invention, there is provided an organic light emitting display device including: a plurality of pixels coupled to scan lines and data lines; a plurality of scan driving circuits configured to receive a circuit selection signal and a line control signal, and to output a scan signal to the scan lines, corresponding to the circuit selection signal and the line control signal; a plurality of data driving circuits respectively coupled to the data lines, the plurality of data driving circuits being configured to select at least one of a first pre-emphasis voltage, a second pre-emphasis voltage, a first data voltage or a second data voltage, and to output the selected voltage to a corresponding one of the data lines; and a first decoder configured to supply the first pre-emphasis voltage, corresponding to the circuit selection signal and the line control signal.

The organic light emitting display device may further include a second decoder configured to supply the second pre-emphasis voltage, corresponding to the circuit selection signal and the line control signal.

The organic light emitting display device may further include a timing controller configured to supply the circuit selection signal and the line control signal to the scan driving circuits, the first decoder and the second decoder.

The first decoder may be configured to supply the first pre-emphasis voltage, corresponding to some of bits of the circuit selection signal and some of bits of the line control signal, and the second decoder may be configured to supply the second pre-emphasis voltage, corresponding to some of bits of the circuit selection signal and some of bits of the line control signal.

The data driving circuits may be configured to supply the first data voltage after the first pre-emphasis voltage is supplied, and to supply the second data voltage after the second pre-emphasis voltage is supplied.

The first pre-emphasis voltage may have a voltage level higher than that of the first data voltage, and the second pre-emphasis voltage may have a voltage level lower than that of the second data voltage.

Each data driving circuit of the plurality of data driving circuits may include: a first transistor coupled between a first voltage line for receiving the first pre-emphasis voltage supplied from the first decoder and an output node coupled to a corresponding one of the data lines; a second transistor coupled between a second voltage line for receiving the second pre-emphasis voltage supplied from a second decoder and the output node; a third transistor coupled between a third voltage line for receiving the first data voltage and the output node; and a fourth transistor coupled between a fourth voltage line for receiving the second data voltage and the output node.

A corresponding one of the scan driving circuits selected by the circuit selection signal may be configured to output the scan signal to a scan line corresponding to the line control signal.

Each pixel of the plurality of pixels may include an organic light emitting diode.

According to another aspect of the present invention, there is provided an organic light emitting display device including: a plurality of pixels coupled to scan lines and data lines; a plurality of scan driving circuits configured to receive a circuit selection signal and a line control signal, and to output a scan signal to the scan lines, corresponding to the circuit selection signal and the line control signal; a plurality of data driving circuits respectively coupled to the data lines, the plurality of data driving circuits being configured to select at least one of a first pre-emphasis voltage, a second pre-emphasis voltage, a first data voltage or a second data voltage, and to output the selected voltage to a corresponding one of the data lines; and a data controller configured to control whether or not the first and second pre-emphasis voltages are output, corresponding to the circuit selection signal.

The organic light emitting display device may further include a timing controller configured to supply the circuit selection signal and the line control signal to the scan driving circuits, and to supply the circuit selection signal to the data controller.

A corresponding one of the scan driving circuits selected by the circuit selection signal may be configured to output the scan signal to a scan line corresponding to the line control signal.

The data controller may be configured to divide the circuit selection signal into a plurality of circuit selection signals, and to control the data driving circuits not to output the first and second pre-emphasis voltages during a first driving period in which the scan driving circuits selected by some of the plurality of circuit selection signals output the scan signal, and the data controller may be configured to control the data driving circuits to output the first and second pre-emphasis voltages during a second driving period in which the scan driving circuits selected by others of the plurality of circuit selection signals output the scan signal.

During the second driving period, the data driving circuits may be configured to supply the first data voltage after the first pre-emphasis voltage is supplied, and to supply the second data voltage after the second pre-emphasis voltage is supplied.

The first pre-emphasis voltage may have a voltage level higher than that of the first data voltage, and the second pre-emphasis voltage may have a voltage level lower than that of the second data voltage.

Each data driving circuit of the plurality of data driving circuits may include: a first transistor coupled between a first voltage line for receiving the first pre-emphasis voltage and an output node coupled to a corresponding one of the data lines; a second transistor coupled between a second voltage line for receiving the second pre-emphasis voltage and the output node; a third transistor coupled between a third voltage line for receiving the first data voltage and the output node; and a fourth transistor coupled between a fourth voltage line for receiving the second data voltage and the output node.

Each pixel of the plurality of pixels may include an organic light emitting diode.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be more thorough and complete, and will more fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
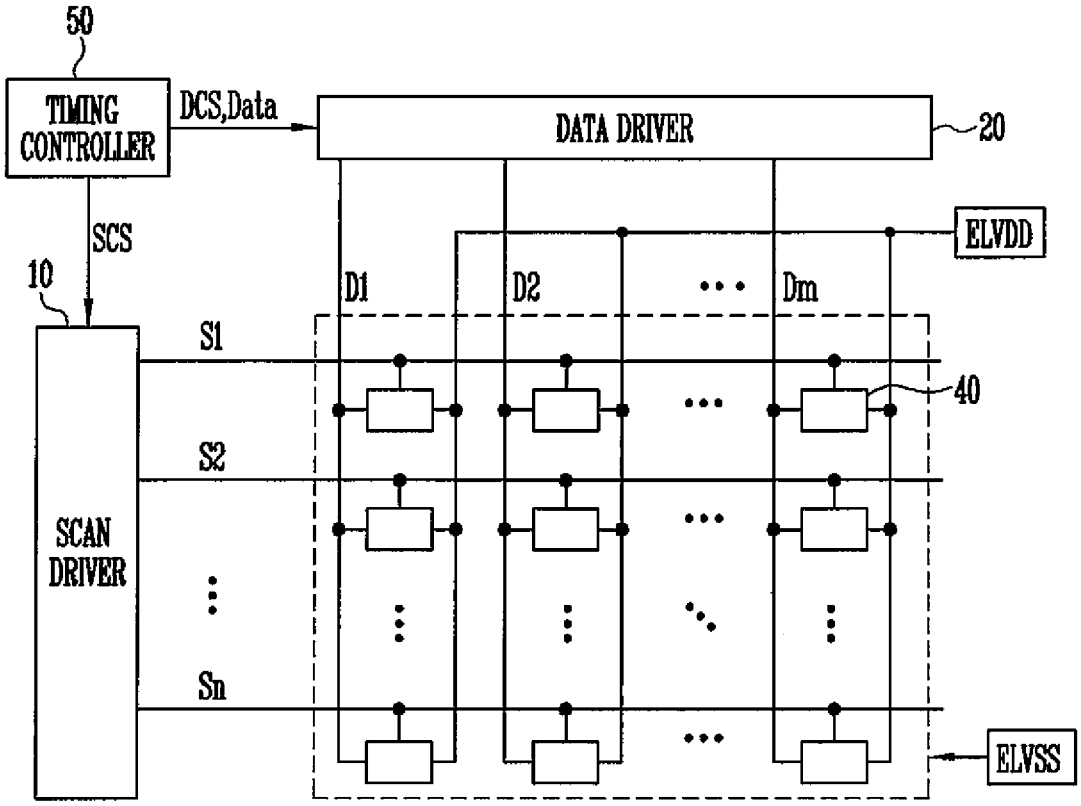
FIG. 1 is a diagram illustrating an organic light emitting display device according to an embodiment of the present invention.

Hereinafter, certain example embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention may be omitted for clarity. Also, like reference numerals refer to like elements throughout.

FIG. 1 is a diagram illustrating an organic light emitting display device according to an embodiment of the present invention.

Referring to FIG. 1, an organic light emitting display device according to this embodiment may include a plurality of pixels 40 coupled to scan lines S1 to Sn and data lines D1 to Dm, a scan driver 10 configured to supply a scan signal to the pixels 40 through the scan lines S1 to Sn, a data driver 20 configured to supply a data signal to the pixels 40 through the data lines D1 to Dm, and a timing controller 50 configured to control the scan driver 10 and the data driver 20.

The timing controller 50 may generate a data driving control signal DCS and a scan driving control signal SCS, corresponding to signals supplied from an outside thereof.

The timing controller 50 may supply the generated data driving control signal DCS to the data driver 20, and supply the generated scan driving control signal SCS to the scan driver 10.

The timing controller 50 may supply image data Data supplied from the outside to the data driver 20.

The data driver 20 may supply a data voltage to the data lines D1 to Dm for each subframe of a plurality of subframes included in one frame.

Here, the data voltage may include a first data voltage VGH at which the pixel 40 is in a non-emission state, and a second data voltage VGL at which the pixel 40 is in an emission state.

That is, the data driver 20 may supply the first and second data voltages VGH and VGL for controlling whether or not the pixel 40 emits light, to the data lines D1 to Dm every subframe.

In order to reduce the charging time of the data voltage, the data driver 20 may supply a first pre-emphasis voltage Vp1 before the supply of the first data voltage VGH, and supply a second pre-emphasis voltage Vp2 before the supply of the second data voltage VGL.

For example, the first data voltage VGH may have a voltage level higher than that of the second data voltage VGL.

The scan driver 10 may supply a scan signal to the scan lines S1 to Sn every subframe.

For example, if the scan signal is sequentially supplied to the scan lines S1 to Sn, pixels 40 are sequentially selected for each line, and the selected pixels 40 may receive the first or second data voltage VGH or VGL supplied from the data lines D1 to Dm.

Each pixel 40 receiving first and second voltages ELVDD and ELVSS receive the data voltage (the first or second data voltage VGH or VGL) when the scan signal is supplied. The pixel 40 may emit light or may not emit light during each subframe, corresponding to the received data voltage.

Figure 2:
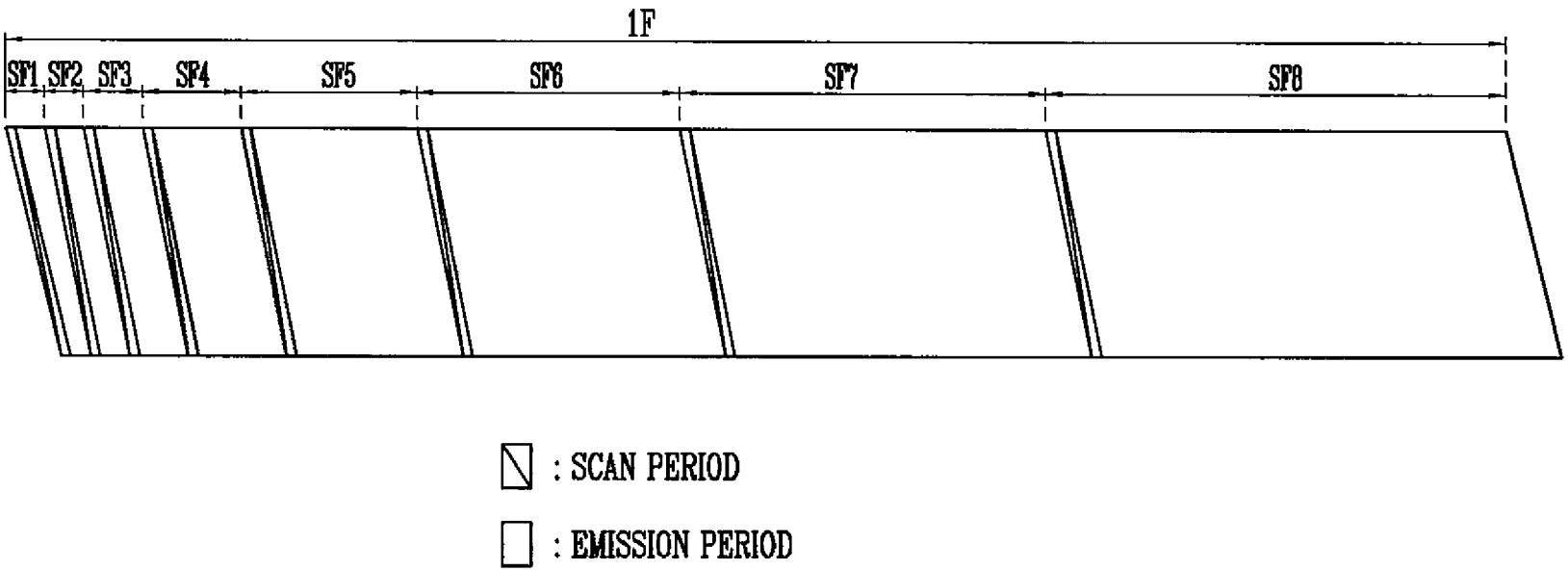
FIG. 2 is a diagram illustrating one frame of an organic light emitting display device according to an embodiment of the present invention.

FIG. 2 is a diagram illustrating one frame of an organic light emitting display device according to an embodiment of the present invention.

Although it has been illustrated in FIG. 2 that, for convenience of illustration, one frame 1F is divided into eight subframes SF1 to SF8, the present invention is not limited thereto.

Referring to FIG. 2, the one frame 1F of the organic light emitting display device according to this embodiment may be divided into a plurality of subframes SF1 to SF8 for driving the organic light emitting display device.

Each of the subframes SF1 to SF8 may be divided into a scan period and an emission period.

The scan signal may be sequentially supplied to the scan lines S1 to Sn during the scan period.

During the scan period, the data voltage may be supplied to the data lines D1 to Dm to be synchronized with the scan signal. That is, the pixels 40 may receive the first or second data voltage VGH or VGL during the scan period.

During the emission period, each pixel 40 may emit light or may not emit light, corresponding to the data voltage supplied during the scan period.

For example, the pixels 40 receiving the first data voltage VGH during the scan period may be set in the non-emission state during a corresponding subframe, and the pixels 40 receiving the second data voltage VGL during the scan period may be set in the emission state during a corresponding subframe.

Here, the scan period may be set substantially identically (e.g., identically) in the subframes SF1 to SF8, and the emission period may be set differently in the subframes SF1 to SF8.

For example, the emission period may be increased at a ratio of $2^0$, $2^1$, $2^2$, $2^3$, $2^4$, $2^5$, $2^6$ and $2^7$ in the subframes SF1 to SF8.

That is, in this embodiment, the pixels 40 may express an image having gray levels or gray scale levels (e.g., predetermined gray scale levels) while emitting light or not emitting light in each of the subframes SF1 to SF8 included in the one frame 1F.

Thus, in this embodiment, a gray level or gray scale level (e.g., predetermined gray scale level) can be expressed during the one frame 1F, corresponding to (or utilizing) the sum of times (or length of times) when each pixel 40 emits light during the subframes.

Meanwhile, in this embodiment, each of the subframes SF1 to SF8 included in the one frame 1F may be changed in various forms. For example, a reset period may be added to each of the subframes SF1 to SF8. The emission period of each of the subframes SF1 to SF8 may also be variously changed.

Figure 3:
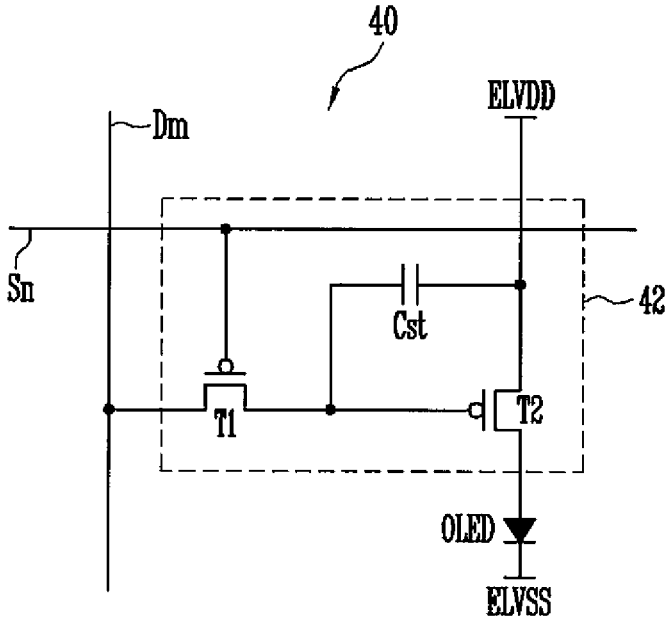
FIG. 3 is a circuit diagram illustrating an embodiment of a pixel shown in FIG. 1.

FIG. 3 is a circuit diagram illustrating an embodiment of a pixel shown in FIG. 1. For convenience of illustration, a pixel coupled to an n-th scan line Sn and an m-th data line Dm is shown in FIG. 3.

Referring to FIG. 3, the pixel 40 includes an organic light emitting diode OLED, and a pixel circuit 42 coupled to the data line Dm and the scan line Sn to control whether or not the organic light emitting diode OLED emits light.

An anode electrode of the organic light emitting diode OLED is coupled to the pixel circuit 42, and a cathode electrode of the organic light emitting diode OLED is coupled to the second voltage ELVSS.

The organic light emitting diode OLED may emit light or may not emit light for each of the subframes SF1 to SF8, corresponding to current supplied from the pixel circuit 42.

The pixel circuit 42 may control whether or not the organic light emitting diode emits light, corresponding to a data voltage supplied to the data line Dm when a scan signal is supplied to the scan line Sn.

To this end, the pixel circuit 42 may include a second pixel transistor T2 coupled between the first voltage ELVDD and the organic light emitting diode OLED, a first pixel transistor T1 coupled between the data line Dm and the scan line Sn, and a storage capacitor Cst coupled between a gate electrode and a first electrode of the second pixel transistor T2.

A gate electrode of the first pixel transistor T1 is coupled to the scan line Sn, and a first electrode of the first pixel transistor T1 is coupled to the data line Dm. A second electrode of the first pixel transistor T1 may be coupled to one terminal of the storage capacitor Cst.

The first pixel transistor T1 is turned on when the scan signal is supplied to the scan line Sn in each of the subframes SF1 to SF8, to supply, to the storage capacitor Cst, the data voltage supplied to the data line Dm.

Here, the first electrode may be set as any one of source and drain electrodes, and the second electrode may be set as an electrode different from the first electrode. For example, if the first electrode is set as the source electrode, the second electrode is set as the drain electrode.

The gate electrode of the second pixel transistor T2 is coupled to the one terminal of the storage capacitor Cst, and the first electrode of the second pixel transistor T2 is coupled to the other terminal of the storage capacitor Cst and the first voltage ELVDD.

A second electrode of the second pixel transistor T2 may be coupled to the organic light emitting diode OLED. The second pixel transistor T2 controls whether or not the organic light emitting diode OLED emits light, corresponding to a voltage stored in the storage capacitor Cst.

For example, when the second data voltage VGL is applied to the storage capacitor Cst, the second pixel transistor T2 may supply a current (e.g., a predetermined current) so that the organic light emitting diode OLED emits light.

When the first data voltage VGH is applied to the storage capacitor Cst, the second pixel transistor T2 may not supply current so that the organic light emitting diode OLED does not emit light.

The pixel structure of FIG. 3 described above is merely an example embodiment, and therefore, the pixel 40 of the present invention is not limited to the pixel structure of FIG. 3. For example, the pixel circuit 42 may have a circuit structure capable of supplying current to the organic light emitting diode OLED, and may be selected as any one of various structures known in the art.

Figure 4:
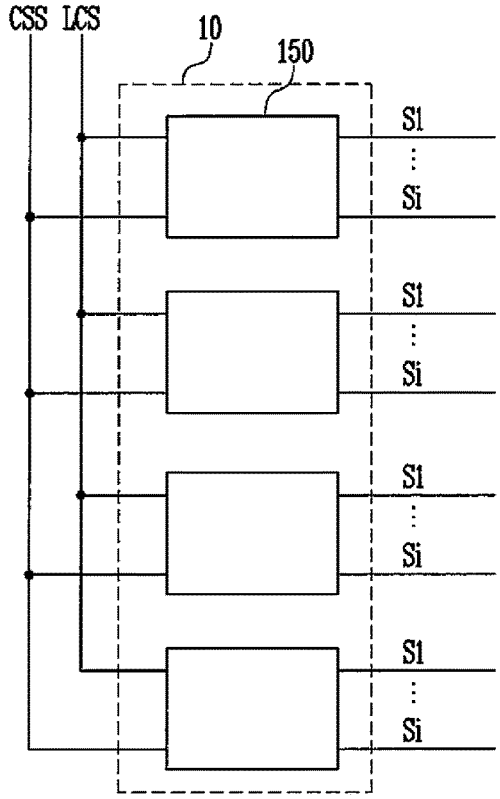
FIG. 4 is a diagram illustrating a scan driver according to an embodiment of the present invention.

FIG. 4 is a diagram illustrating a scan driver according to an embodiment of the present invention.

The scan driver 10 according to this embodiment may be controlled by the scan driving control signal SCS supplied from the timing controller 50.

For example, the scan driving control signal SCS may include a circuit selection signal CSS and a line control signal LCS.

The circuit selection signal CSS and the line control signal LCS may be digital signals.

Referring to FIG. 4, the scan driver 10 according to this embodiment may include a plurality of scan driving circuits 150.

The scan driving circuits 150 may receive the circuit selection signal CSS and the line control signal LCS, input from the timing controller 50, and output a scan signal to the scan lines S1 to Sn, corresponding to the circuit selection signal CSS and the line control signal LCS.

Each of the scan driving circuits 150 may be coupled to a plurality of different scan lines.

For example, as shown in FIG. 4, each scan driving circuit 150 may be coupled to i scan lines S1 to Si.

The numbers of scan lines coupled to the respective scan driving circuits 150 may be identical or different from one another.

Any one of the plurality of scan driving circuits 150 may be selected by the circuit selection signal CSS supplied from the timing controller 50.

In one embodiment, the scan driving circuit 150 selected by the circuit selection signal CSS may output the scan signal to a scan line corresponding to the line control signal LCS.

For example, from the upper side of FIG. 4, a first scan driving circuit 150 may be set corresponding to "100", a second scan driving circuit 150 may be set corresponding to "101", a third scan driving circuit 150 may be set corresponding to "110", and a fourth scan driving circuit 150 may be set corresponding to "111".

When a circuit selection signal CSS having a bit value of "101" is supplied, the second scan driving circuit among the plurality of scan driving circuits 150 may be selected.

In one embodiment, when a line control signal (e.g., having a bit value of "11001000") corresponding to a two-hundredth scan line S200 is supplied, the second scan driving circuit may output the scan signal to the two-hundredth scan line S200 among the scan lines S1 to Si coupled thereto.

When a circuit selection signal CSS having a bit value of "100" is supplied, and line control signals LCS having bit values of "00000001", "00000010", "00000011" to "11001000" are sequentially supplied, the first scan driving circuit 150 may sequentially supply the scan signal to the first scan line S1, the second scan line S2, the third scan line S3 to the two-hundredth scan line S200.

Figure 5:
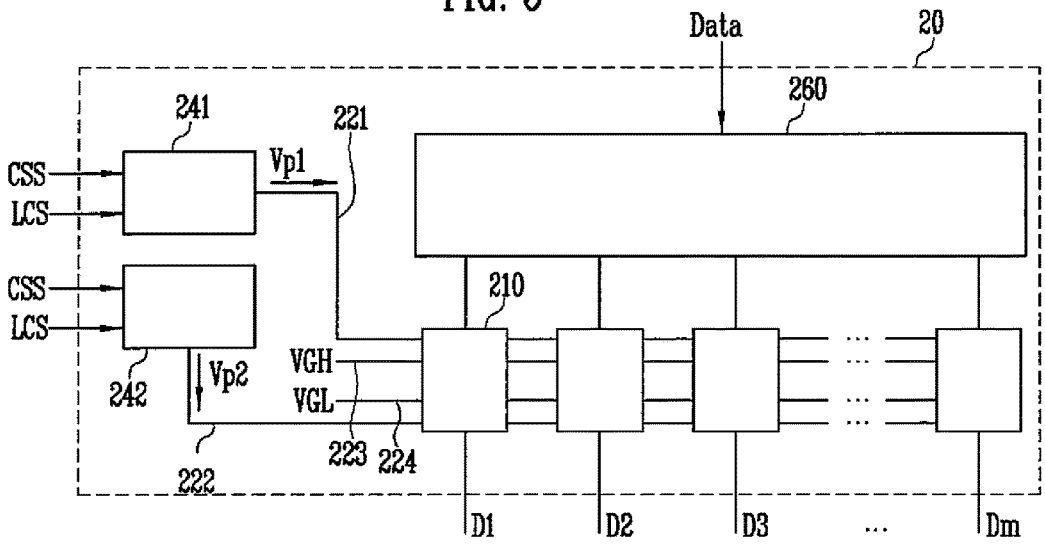
FIG. 5 is a diagram illustrating a data driver according to an embodiment of the present invention.

FIG. 5 is a diagram illustrating a data driver according to an embodiment of the present invention.

Referring to FIG. 5, the data driver 20 according to this embodiment may include a plurality of data driving circuits 210, a first decoder 241 and a second decoder 242.

The data driver 20 according to this embodiment may further include a data controller 260 configured to control the plurality of data driving circuits 210.

The data driving circuits 210 may be respectively coupled to the data lines D1 to Dm.

For example, the data driving circuits 210 and the data lines D1 to Dm may be coupled to correspond to each other.

The data driving circuits 210 may output, to the data lines D1 to Dm, the first and second voltages VGH and VGL for determining whether or not the corresponding pixel 40 emits light, under the control of the data controller 260.

That is, the data controller 260 receives image data Data supplied from the timing controller 50, and controls the data driving circuits 210 to supply a data voltage corresponding to the image data Data for each subframe, thereby displaying a desired image.

In one embodiment, the data driving circuits 210 may output not only the first data voltage VGH and the second data voltage VGL but also the first pre-emphasis voltage Vp1 and the second pre-emphasis voltage Vp2.

To this end, the data driving circuits 210 may receive the first data voltage VGH, the second data voltage VGL, the first pre-emphasis voltage Vp1 and the second pre-emphasis voltage Vp2, and output, to a corresponding data line, any one (or at least one) selected from the first data voltage VGH, the second data voltage VGL, the first pre-emphasis voltage Vp1 and the second pre-emphasis voltage Vp2.

In one embodiment, the first pre-emphasis voltage Vp1 is used (or utilized) to reduce the charging time of the first data voltage VGH, and the data driving circuits 210 may supply the first data voltage VGH after the pre-emphasis voltage Vp1 is supplied.

According to an embodiment, the first pre-emphasis voltage Vp1 has a voltage level higher than that of the first data voltage VGH.

The second pre-emphasis voltage Vp2 is used (or utilized) to reduce the charging time of the second data voltage VGL, and the data driving circuits 210 may supply the second data voltage VGL after the second pre-emphasis voltage Vp2 is supplied.

According to an embodiment, the second pre-emphasis voltage Vp2 has a voltage level lower than that of the second data voltage VGL.

The data driving circuits 210 may be coupled to a first voltage line 221, a second voltage line 222, a third voltage line 223 and a fourth voltage line 224 in order to receive the first pre-emphasis voltage Vp1, the second pre-emphasis voltage Vp2, the first data voltage VGH and the second data voltage VGL.

The first voltage line 221 may receive the first pre-emphasis voltage Vp1 to transmit the received first pre-emphasis voltage Vp1 to the data driving circuits 210.

For example, the first voltage line 221 may receive the first pre-emphasis voltage Vp1 supplied from the first decoder 241.

The second voltage line 222 may receive the second pre-emphasis voltage Vp2 to transmit the received second pre-emphasis voltage Vp2 to the data driving circuits 210.

For example, the second voltage line 222 may receive the second pre-emphasis voltage Vp2 supplied from the second decoder 242.

The third voltage line 223 may receive the first data voltage VGH to transmit the received first data voltage VGH to the data driving circuit 210.

The fourth voltage line 224 may receive the second data voltage VGL to transmit the received second data voltage VGL to the data driving circuits 210.

For example, the third and fourth voltage lines 223 and 224 may receive the first and second data voltages VGH and VGL supplied from separate voltage supply units (not shown), respectively.

The first decoder 241 may supply the first pre-emphasis voltage Vp1 to the first voltage line 221.

Thus, the first decoder 241 can supply the first pre-emphasis voltage Vp1 to the data driving circuits 210 through the first voltage line 221.

The first decoder 241 may supply or change the first pre-emphasis voltage Vp1, corresponding to the circuit selection signal CSS and the line control signal LCS.

In one embodiment, the circuit selection signal CSS and the line control signal LCS may be supplied from the timing controller 50.

For example, the first decoder 241 may output, as the first pre-emphasis voltage Vp1, a voltage corresponding to a combination of the circuit selection signal CSS and the line control signal LCS.

That is, when the circuit selection signal CSS having the bit value of "101" and the line control signal LCS having the bit value of "11001000" are supplied, the first decoder 241 may output a voltage corresponding to "10111001000" as the first pre-emphasis voltage Vp1.

Therefore, when the circuit selection signal CSS and the line control signal LCS are changed, the first pre-emphasis voltage Vp1 may also be changed.

To this end, the first decoder 241 may generate a plurality of voltages having different voltage levels. The first decoder 241 may select any one (or at least one) of the plurality of voltages, corresponding to the circuit selection signal CSS and the line control signal LCS, and output the selected voltage as the first pre-emphasis voltage Vp1.

Meanwhile, for convenience of driving, the first decoder 241 may supply or change the first pre-emphasis voltage Vp1, corresponding to a portion of the bit value of the circuit selection signal CSS and a portion of the bit value of the line control signal LCS.

For example, when the circuit selection signal CSS having the bit value of "101" and the line control signal LCS having the bit value of "11001000" are supplied, the first decoder 241 may supply or change the first pre-emphasis voltage Vp1, using (or utilizing) "01" that is a portion of "101" (e.g., lower two bits) and "1100" that is a portion of "11001000" (e.g., upper four bits).

That is, the first decoder 241 may select a voltage corresponding to "011100" that is a combination of the portions ("01" and "1100") of the two bit values, and output the selected voltage as the first pre-emphasis voltage Vp1.

The second decoder 242 may supply the second pre-emphasis voltage Vp2 to the second voltage line 222.

Thus, the second decoder 242 can supply the second pre-emphasis voltage Vp2 to the data driving circuits 210 through the second voltage line 222.

The second decoder 242 may supply or change the second per-emphasis voltage Vp2, corresponding to the circuit selection signal CSS and the line control signal LCS.

In one embodiment, the circuit selection signal CSS and the line control signal LCS may be supplied from the timing controller 50.

For example, the second decoder 242 may output, as the second pre-emphasis voltage Vp2, a voltage corresponding to a combination of the circuit selection signal CSS and the line control signal LCS.

That is, when the circuit selection signal CSS having the bit value of "101" and the line control signal LCS having the bit value of "11001000" are supplied, the second decoder 242 may output a voltage corresponding to "10111001000" as the second pre-emphasis voltage Vp2.

Therefore, when the circuit selection signal CSS and the line control signal LCS are changed, the second pre-emphasis voltage Vp2 may also be changed.

To this end, the second decoder 242 may generate a plurality of voltages having different voltage levels. The second decoder 242 may select any one (or at least one) of the plurality of voltages, corresponding to the circuit selection signal CSS and the line control signal LCS, and output the selected voltage as the second pre-emphasis voltage Vp2.

Meanwhile, for convenience of driving, the second decoder 242 may supply or change the second pre-emphasis voltage Vp2, corresponding to a portion of the bit value of the circuit selection signal CSS and a portion of the bit value of the line control signal LCS.

For example, when the circuit selection signal CSS having the bit value of "101" and the line control signal LCS having the bit value of "11001000" are supplied, the second decoder 242 may supply or change the second pre-emphasis voltage Vp2, using (or utilizing) "01" that is a portion of "101" (e.g., lower two bits) and "1100" that is a portion of "11001000" (e.g., upper four bits).

That is, the second decoder 242 may select a voltage corresponding to "011100" that is a combination of the portions ("01" and "1100") of the two bit values, and output the selected voltage as the second pre-emphasis voltage Vp2.

Figure 6:
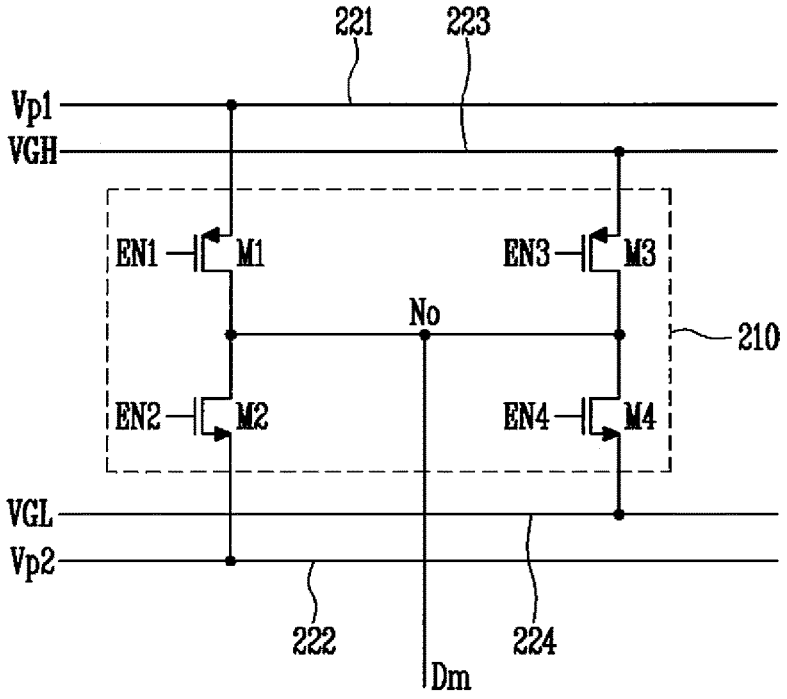
FIG. 6 is a circuit diagram illustrating a data driving circuit according to an embodiment of the present invention.

FIG. 6 is a circuit diagram illustrating a data driving circuit according to an embodiment of the present invention. For convenience of illustration, a data driving circuit coupled to an m-th data line Dm is shown in FIG. 6.

Referring to FIG. 6, the data driving circuit 210 according to this embodiment may include a first transistor M1, a second transistor M2, a third transistor M3 and a fourth transistor M4.

The first transistor M1 may be coupled between the first voltage line 221 and an output node No.

For example, the on-off operation of the first transistor may be controlled corresponding to a first control signal EN1 supplied from the data controller 260.

Thus, when the first transistor M1 is turned on, the first pre-emphasis voltage Vp1 can be output to the corresponding data line Dm.

The second transistor M2 may be coupled between the second voltage line 222 and the output node No.

For example, the on-off operation of the second transistor M2 may be controlled corresponding to a second control signal EN2 supplied from the data controller 260.

Thus, when the second transistor M2 is turned on, the second pre-emphasis voltage Vp2 can be output to the corresponding data line Dm.

The third transistor M3 may be coupled between the third voltage line 223 and the output node No.

For example, the on-off operation of the third transistor M3 may be controlled corresponding to a third control signal EN3 supplied from the data controller 260.

Thus, when the third transistor M3 is turned on, the first data voltage VGH can be output to the corresponding data line Dm.

The fourth transistor M4 may be coupled between the fourth voltage line 224 and the output node No.

For example, the on-off operation of the fourth transistor M4 may be controlled corresponding to a fourth control signal EN4 supplied from the data controller 260.

Thus, when the fourth transistor M4 is turned on, the second data voltage VGL can be output to the corresponding data line Dm.

The output node No is a node to which the first, second, third and fourth transistors M1, M2, M3 and M4 are commonly coupled, and may be coupled to the corresponding data line Dm.

Figure 7:
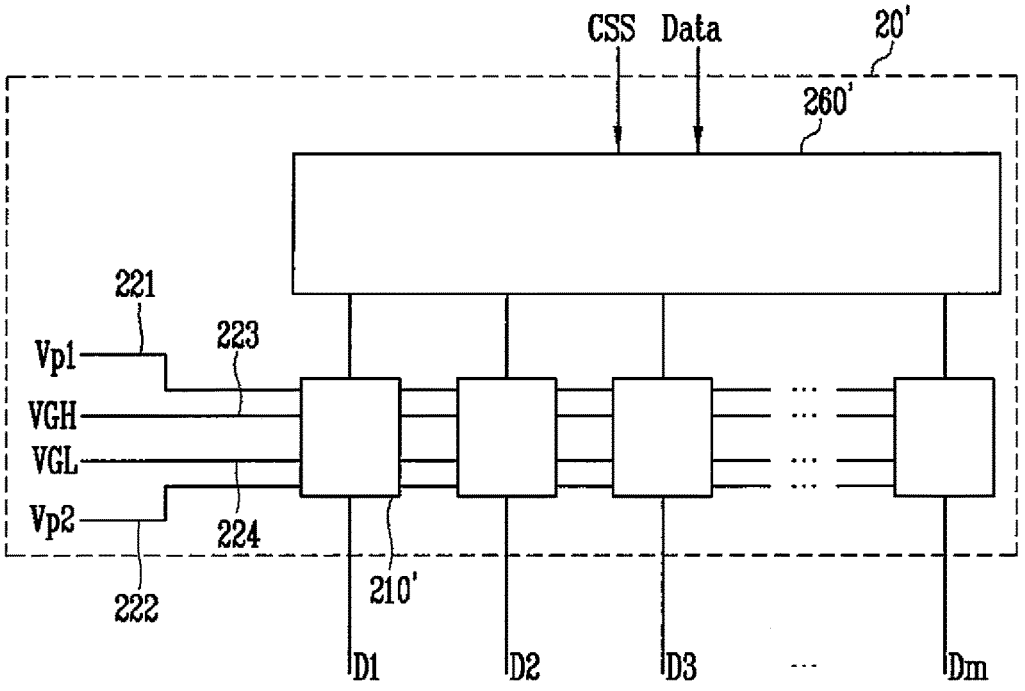
FIG. 7 is a diagram illustrating a data driver according to another embodiment of the present invention.

FIG. 7 is a diagram illustrating a data driver according to another embodiment of the present invention. Here, components different from those of the embodiment shown in FIG. 5 will be mainly described, and descriptions overlapping with those of the aforementioned embodiment may be omitted.

Referring to FIG. 7, the data driver 20' according to this embodiment may include a plurality of data driving circuits 210 and a data controller 260'.

The data driving circuits 210' may be respectively coupled to the data lines D1 to Dm.

For example, the data driving circuits 210' and the data lines D1 to Dm may be coupled to correspond to each other.

The data driving circuits 210' may output, to the data lines D1 to Dm, the first and second voltages VGH and VGL for determining whether or not the pixel 40 emits light, under the control of the data controller 260'.

That is, the data controller 260' receives image data Data supplied from the timing controller 50, and controls the data driving circuits 210' to supply a data voltage corresponding to the image data Data for each subframe, thereby displaying a desired image.

In one embodiment, the data driving circuits 210' may output not only the first data voltage VGH and the second data voltage VGL but also the first pre-emphasis voltage Vp1 and the second pre-emphasis voltage Vp2.

To this end, the data driving circuits 210' may receive the first data voltage VGH, the second data voltage VGL, the first pre-emphasis voltage Vp1 and the second pre-emphasis voltage Vp2, and output, to a corresponding data line, any one (or at least one) selected from the first data voltage VGH, the second data voltage VGL, the first pre-emphasis voltage Vp1 and the second pre-emphasis voltage Vp2.

In one embodiment, the first pre-emphasis voltage Vp1 is used (or utilized) to reduce the charging time of the first data voltage VGH, and the data driving circuits 210' may supply the first data voltage VGH after the pre-emphasis voltage Vp1 is supplied.

The first pre-emphasis voltage Vp1 preferably has a voltage level higher than that of the first data voltage VGH.

The second pre-emphasis voltage Vp2 is used (or utilized) to reduce the charging time of the second data voltage VGL, and the data driving circuits 210' may supply the second data voltage VGL after the second pre-emphasis voltage Vp2 is supplied.

The second pre-emphasis voltage Vp2 preferably has a voltage level lower than that of the second data voltage VGL.

In one embodiment, the data controller 260' may control whether or not the first and second pre-emphasis voltages Vp1 and Vp2 are output, corresponding to the circuit selection signal CSS supplied from the timing controller 50.

For example, during a specific period, the data controller 260' may control the data driving circuits 210' to output only the first and second data voltages VGH and VGL, and not the first and second pre-emphasis voltages Vp1 and Vp2. During the other periods, the data controller 260' may control the data driving circuits 210' to output the first and second data voltages VGH and VGL together with the first and second pre-emphasis voltages Vp1 and Vp2.

In one embodiment, the data controller 260' may divide the circuit selection signal into a plurality of circuit selection signals CSS input thereto, and control the data driving circuits 210' not to output the first and second pre-emphasis voltages Vp1 and Vp2 during a first driving period in which the scan driving circuits 150 selected by some of the plurality of circuit selection signals CSS output the scan signal.

The data controller 260' may control the data driving circuits 210' to output the first and second pre-emphasis voltages Vp1 and Vp2 during a second driving period in which the scan driving circuits 150 selected by the others of the plurality of circuit selection signals CSS output the scan signal.

For example, when a circuit selection signal CSS having a bit value of "100" is supplied during the first driving period, the first scan driving circuit 150 from the upper side of FIG. 4 may be selected. Accordingly, the first scan driving circuit 150 can output the scan signal, corresponding to the line control signal LCS during the first driving period.

When circuit selection signals CSS having bit values "101", "110" and "111" are supplied during the second driving period, the second, third and fourth scan driving circuits 150 from the upper side of FIG. 4 may be sequentially selected. Accordingly, the second, third and fourth scan driving circuits 150 can sequentially output the scan signal, corresponding to the line control signal LCS during the second driving period.

In one embodiment, when the circuit selection signal CSS having the bit value of "100" is supplied, the data controller 260' may control the data driving circuits 210' not to output the first and second pre-emphasis voltages Vp1 and Vp2.

When the circuit selection signals CSS having the bit values "101", "110" and "111" are supplied, the data controller 260' may control the data driving circuits 210' to output the first and second voltages VGH and VGL together with the first and second pre-emphasis voltages Vp1 and Vp2.

Accordingly, only the first and second data voltages VGH and VGL may be output from the data driving circuits 210' during the first driving period, and the first and second data voltages VGH and VGL together with the first and second pre-emphasis voltages Vp1 and Vp2 may be output from the data driving circuits 210' during the second driving period.

The data driving circuits 210' may be coupled to a first voltage line 221, a second voltage line 222, a third voltage line 223 and a fourth voltage line 224 in order to receive the first pre-emphasis voltage Vp1, the second pre-emphasis voltage Vp2, the first data voltage VGH and the second data voltage VGL.

The first voltage line 221 may receive the first pre-emphasis voltage Vp1 to transmit the received first pre-emphasis voltage Vp1 to the data driving circuits 210'.

The second voltage line 222 may receive the second pre-emphasis voltage Vp2 to transmit the received second pre-emphasis voltage Vp2 to the data driving circuits 210'.

For example, the first and second voltage lines 221 and 222 may receive the first and second pre-emphasis voltages Vp1 and Vp2 from separate voltage supply units (not shown), respectively.

The third voltage line 223 may receive the first data voltage VGH to transmit the received first data voltage VGH to the data driving circuits 210'.

The fourth voltage line 224 may receive the second data voltage VGL to transmit the received second data voltage VGL to the data driving circuits 210'.

For example, the third and fourth voltage lines 223 and 224 may receive the first and second data voltages VGH and VGL from separate voltage supply units (not shown), respectively.

By way of summation and review, an organic light emitting display device according to an embodiment generally includes pixels arranged in a matrix form, a data driver configured to drive data lines coupled to the pixels, and a scan driver configured to drive scan lines coupled to the pixels.

The scan driver may select pixels for each line while sequentially supplying a scan signal to the scan lines. The data driver may supply a data signal to the data lines to be synchronized with the scan signal.

Accordingly, the data signal can be supplied to the pixels selected by the scan signal. The pixels can charge a voltage corresponding to the data signal, and generate light with a luminance corresponding to the charged voltage.

Recently, the resolution of display devices has been gradually increased according to users' requirements, and therefore, it is desirable to reduce the charging time of a data signal.

Conventionally, there was used a method for supplying a pre-emphasis voltage before the supply of a data signal in order to reduce the charging time of the data signal.

However, conventionally, it was difficult (or impossible) to regulate the level of the pre-emphasis voltage or to control whether or not the pre-emphasis voltage is supplied.

As described above, according to an aspect of the present invention, the pre-emphasis voltage can be changed corresponding to the circuit selection signal and the line control signal.

Further, it is possible to control whether or not the pre-emphasis voltage is supplied, corresponding to the circuit selection signal.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used alone or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and their equivalents.

What is claimed is:

1. An organic light emitting display device comprising:

a plurality of pixels coupled to scan lines and data lines;

a plurality of scan driving circuits configured to receive a circuit selection signal and a line control signal, and to output a scan signal to the scan lines, corresponding to the circuit selection signal and the line control signal;

a plurality of data driving circuits respectively coupled to the data lines, the plurality of data driving circuits being configured to select at least one of a first pre-emphasis voltage received from a first decoder, a second pre-emphasis voltage, a first data voltage or a second data voltage, and to output the selected voltage to a corresponding one of the data lines; and the first decoder configured to supply the first pre-emphasis voltage to the plurality of data driving units, corresponding to the circuit selection signal and the line control signal.

2. The organic light emitting display device of claim 1, further comprising a second decoder configured to supply the second pre-emphasis voltage, corresponding to the circuit selection signal and the line control signal.

3. The organic light emitting display device of claim 2, further comprising a timing controller configured to supply the circuit selection signal and the line control signal to the scan driving circuits, the first decoder and the second decoder.

4. The organic light emitting display device of claim 2, wherein the first decoder is configured to supply the first pre-emphasis voltage, corresponding to some of bits of the circuit selection signal and some of bits of the line control signal, and wherein the second decoder is configured to supply the second pre-emphasis voltage, corresponding to some of bits of the circuit selection signal and some of bits of the line control signal.

5. The organic light emitting display device of claim 1, wherein the data driving circuits are configured to supply the first data voltage after the first pre-emphasis voltage is supplied, and to supply the second data voltage after the second pre-emphasis voltage is supplied.

6. The organic light emitting display device of claim 5, wherein the first pre-emphasis voltage has a voltage level higher than that of the first data voltage, and wherein the second pre-emphasis voltage has a voltage level lower than that of the second data voltage.

7. The organic light emitting display device of claim 1, wherein each data driving circuit of the plurality of data driving circuits comprises:

a first transistor coupled between a first voltage line for receiving the first pre-emphasis voltage supplied from the first decoder and an output node coupled to a corresponding one of the data lines;

a second transistor coupled between a second voltage line for receiving the second pre-emphasis voltage supplied from a second decoder and the output node;

a third transistor coupled between a third voltage line for receiving the first data voltage and the output node; and a fourth transistor coupled between a fourth voltage line for receiving the second data voltage and the output node.

8. The organic light emitting display device of claim 1, wherein a corresponding one of the scan driving circuits selected by the circuit selection signal is configured to output the scan signal to a scan line corresponding to the line control signal.

9. The organic light emitting display device of claim 1, wherein each pixel of the plurality of pixels comprises an organic light emitting diode.

10. An organic light emitting display device comprising:

a plurality of pixels coupled to scan lines and data lines;

a plurality of scan driving circuits configured to receive a circuit selection signal and a line control signal, and to output a scan signal to the scan lines, corresponding to the circuit selection signal and the line control signal;

a plurality of data driving circuits respectively coupled to the data lines, the plurality of data driving circuits being configured to select at least one of a first pre-emphasis voltage, a second pre-emphasis voltage, a first data voltage or a second data voltage, and to output the selected voltage to a corresponding one of the data lines; and a data controller configured to receive the circuit selection signal, and to control whether or not the first and second pre-emphasis voltages are output, corresponding to the circuit selection signal.

11. The organic light emitting display device of claim 10, further comprising a timing controller configured to supply the circuit selection signal and the line control signal to the scan driving circuits, and to supply the circuit selection signal to the data controller.

12. The organic light emitting display device of claim 11, wherein a corresponding one of the scan driving circuits selected by the circuit selection signal is configured to output the scan signal to a scan line corresponding to the line control signal.

13. The organic light emitting display device of claim 12, wherein the data controller is configured to divide the circuit selection signal into a plurality of circuit selection signals, and to control the data driving circuits not to output the first and second pre-emphasis voltages during a first driving period in which the scan driving circuits selected by some of the plurality of circuit selection signals output the scan signal, and wherein the data controller is configured to control the data driving circuits to output the first and second pre-emphasis voltages during a second driving period in which the scan driving circuits selected by others of the plurality of circuit selection signals output the scan signal.

14. The organic light emitting display device of claim 13, wherein, during the second driving period, the data driving circuits are configured to supply the first data voltage after the first pre-emphasis voltage is supplied, and to supply the second data voltage after the second pre-emphasis voltage is supplied.

15. The organic light emitting display device of claim 14, wherein the first pre-emphasis voltage has a voltage level higher than that of the first data voltage, and wherein the second pre-emphasis voltage has a voltage level lower than that of the second data voltage.

16. The organic light emitting display device of claim 15, wherein each data driving circuit of the plurality of data driving circuits comprises:

a first transistor coupled between a first voltage line for receiving the first pre-emphasis voltage and an output node coupled to a corresponding one of the data lines;

a second transistor coupled between a second voltage line for receiving the second pre-emphasis voltage and the output node;

a third transistor coupled between a third voltage line for receiving the first data voltage and the output node; and a fourth transistor coupled between a fourth voltage line for receiving the second data voltage and the output node.

17. The organic light emitting display device of claim 10, wherein each pixel of the plurality of pixels comprises an organic light emitting diode.

18. The organic light emitting display device of claim 10, wherein the data driving circuits are configured to output the first and second data voltages together with the first and second pre-emphasis voltages to the data lines during a driving period from among a plurality of driving periods.

* * * * *